United States Patent [19]

Hochgesang et al.

[11] Patent Number: 4,720,609

[45] Date of Patent: Jan. 19, 1988

[54] PUSHBUTTON SWITCH DEVICE

[75] Inventors: Gerhard Hochgesang, Bad Neustadt/Saale-Lebenhan; Jurgen Oelsch, Hohenroth, both of Fed. Rep. of Germany

[73] Assignee: Preh, Elektrofeinmechanische Werke, Jakob Preh, Nachf. GmbH & Company, Bad Neustadt/Saale, Fed. Rep. of Germany

[21] Appl. No.: 917,736

[22] Filed: Oct. 10, 1986

[30] Foreign Application Priority Data

Oct. 12, 1985 [DE] Fed. Rep. of Germany ..... 3536539

[51] Int. Cl.[4] ..... H01H 13/70

[52] U.S. Cl. ..... 200/5 A; 200/159 B

[58] Field of Search ..... 200/5 A, 5 R, 86 R, 200/159 B, 292, 340

[56] References Cited

U.S. PATENT DOCUMENTS 3,969,600 7/1976 Sims, Jr. ..... 200/159 B
3,996,429 12/1976 Chu et al. ..... 200/5 A
4,029,916 6/1977 Chu ..... 200/5 A
4,527,030 7/1985 Oelsch ..... 200/5 A X

FOREIGN PATENT DOCUMENTS 3041859 3/1982 Fed. Rep. of Germany .

*Primary Examiner*—J. R. Scott
*Attorney, Agent, or Firm*—Woodcock Washburn Kurtz Mackiewicz & Norris

[57] ABSTRACT

A pushbutton switch device has a flat carrier having first and second switch contacts and a switch button arrangement for actuation of the first and second switch contacts. In order that the first and second switch contacts are switched in succession, the switch contacts to be actuated by a switch knob of the switch button arrangement are placed next to one another on the flat carrier. An insert having first and second switching surface parts corresponding to the first and second switch contacts respectively, is placed between the switch knob and the first and second switch contact. Upon initial actuation of the switch knob, the insert closes the first switch contact. Upon continued actuation of the switch knob, the insert will close the second switch contact.

11 Claims, 3 Drawing Figures

PUSHBUTTON SWITCH DEVICE

BACKGROUND OF THE INVENTION

This invention relates to a pushbutton switch device. More particularly, this invention relates to a pushbutton switch device having a flat carrier on which the switch contacts are placed and having a switch button arrangement with several elastic switch buttons, each elastic switch button designed for actuation of a corresponding first and second switch contacts, in which one actuation of the elastic switch button closes two switch contacts, each switch contact consisting of one contact pair and each switch contact being electrically independent of one another, with the stroke of the switch button needed to actuate the first switch contact being greater than the stroke needed for actuation of the second switch contact.

A pushbutton switch device of this kind is described in West German Patent Publication No. DE-OS 30 41 859. There, a pushbutton switch is disclosed where formed onto the flat carrier are switch chambers in which two switch contacts are placed one on top of another. The associated switch button has an elastic rubber switch knob for closing the contacts. When the switch knob is actuated, first the upper switch contact and then the lower switch contact is closed since the switch contacts are placed one above the other. The configuration of the switch knob contributes nothing to the successive switching of the switch contacts, so that the successive switching process depends only on the spacing between the switch contacts or the thickness of the spacer foil separating them. One drawback to such a design is that since the thickness of the spacer foil is small, it is possible for switching to occur practically simultaneously. In addition, the carrier plate must be designed so that the foil carrying the upper switch contact can be deformed since otherwise switching of the lower switch contact would be impossible.

West German Patent Publication No. DE-OS 29 02 769 discloses a similar pushbutton switch device. In this case, only short switching strokes can be executed.

SUMMARY OF THE INVENTION

It is the purpose of this invention to recommend a pushbutton switch device of the above-described type which ensures a successive switching sequence for the switch contacts of the pushbutton switch device. Such successive switching sequence is accomplished by the configuration of the switch button arrangement. Another purpose of this invention is to provide for a pushbutton switch device of the above-mentioned type in which the switch contacts are placed in a space-saving arrangement within the switch chamber.

According to the invention, the above purposes are fulfilled in a pushbutton switch device which provides for the first and second switch contacts which are to be actuated by one switch button are placed next to one another on the carrier, each switch contact having its respective contact surfaces opposite one another in the switching chamber. The switch button which is to actuate each switch contact separately, has a separate switching surface part for each of the first and second switching contacts associated with it such that the spacing between the first switching surface part and the first switch contact is greater than the spacing between the second switching surface part and the second switch contact during activation of the switch button.

The switch button arrangement is designed so that the first and second switch contacts placed next to one another are switched one after the other, since the first switching surface part closes the first switch contact upon actuation of the switch button and then the second switching surface part closes the second switch contact upon further actuation of the switch button Further, the invention is not limited to pushbutton switches where the switch contacts do not need to be placed in a single plane on the carrier. The switch contacts can also be offset in terms of height, with the arrangement then being made so that the height offset reinforces the successive switching action of the pushbutton switch.

In a preferred embodiment of the invention, the switch button has a switch knob and a spring-elastic insert which extends over the switch contacts associated with the switch button and is placed between the switch knob and the switch contacts in the switch chamber. Such spring-elastic insert is provided with an inner region, an outer region and an edge region. The inner region is connected to the outer region by means of a first web, and the outer region is connected to the edge region by means of a second web. The first switching surface part is located in the inner region. The second switching surface part is located diametrically opposite the first switching surface part at the height of the web connecting the inner region to the outer region. The connection between the regions is laid out so that when the switch knob presses on the inner region of the insert, the first switching surface part first actuates the first switch contact and then carries the second switching surface part along, so that it actuates the second switch contact. The insert is a simple plastic part. The insert has the additional advantage that the first and second switching surface parts do not need to be formed onto the elastic rubber switch knob. Further, one advantageous feature of the invention is that the insert needs to be inserted only for those switching buttons in the pushbutton switch device in which actuation of two switch contacts in succession is necessary.

As a further feature, the spring-elastic insert is electrically conductive and acts as a contact element on a switching plane acted upon immediately.

BRIEF DESCRIPTION OF THE DRAWINGS

The present invention may be better understood and its numerous objects and advantages will become apparent to those skilled in the art by reference to the accompanying drawings in which.

DESCRIPTION OF THE PREFERRED EMBODIMENT

Figure 1:
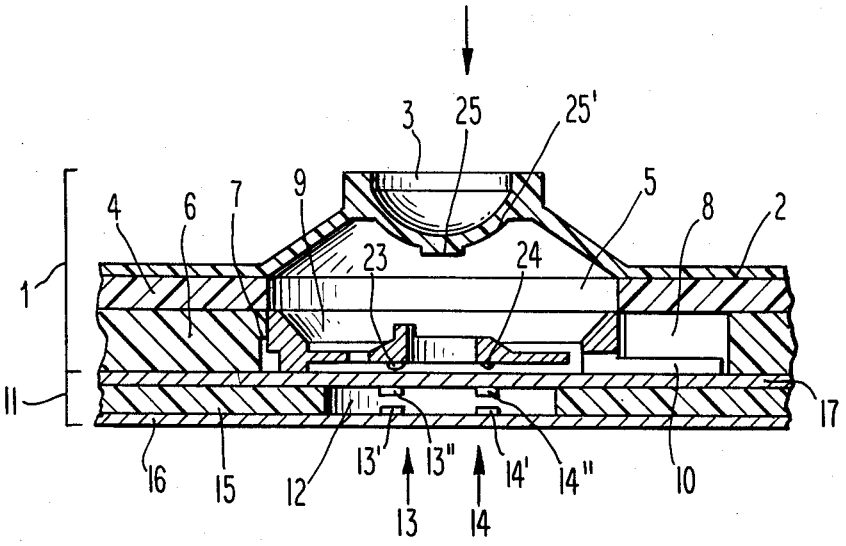
FIG. 1 shows a partial cross-sectional view of a pushbutton switch device which embodies the present invention, said view being taken in the region of its switch button.

Turning first to FIG. 1, a pushbutton switch device is shown which includes a button arrangement 1. Button arrangement 1 is provided with an elastic rubber switch mat 2, onto which are formed a plurality of switch knobs 3. The switch mat 2 is affixed to a dimensionally stable carrier plate 4 which has a recess 5 beneath each switch knob 3. Standard buttons can be placed in a frame above the switch knobs 3.

Figure 2:
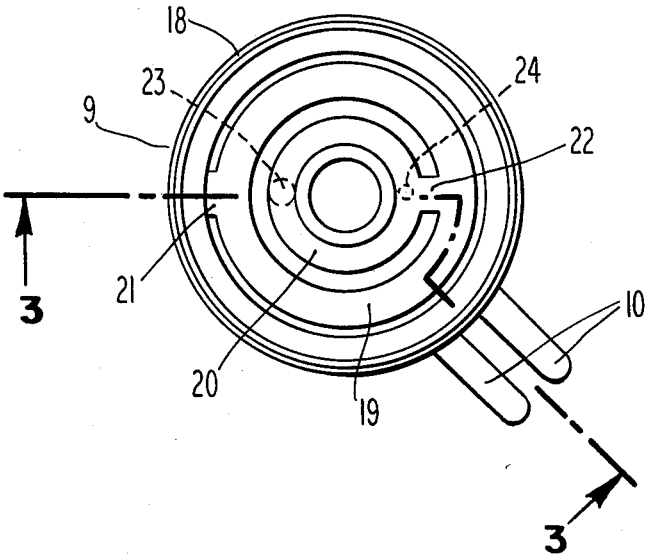
FIG. 2 shows a top view of the insert of FIG. 1.
Figure 3:
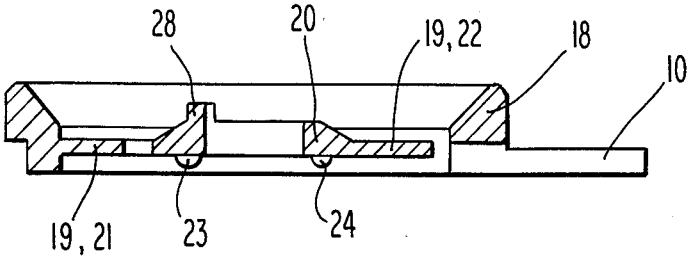
FIG. 3 shows a cross-sectional view of the insert of FIG. 2 taken along line 3—3.

In the example of an embodiment according to FIGS. 1 and 2, a spacer foil 6 is glued beneath the carrier plate 4. The spacer foil 6 includes, beneath the recess 5, an opening 7, which is additionally fitted with cutouts 8. Projecting into the opening 7 and, if applicable, into the recess 5, is an insert 9 which has a circular circumference. For alignment of the insert 9, insert 9 is provided with fingers 10, which sit in the cutouts 8.

Glued beneath the spacer foil 6 is a flat carrier 11 with switch contacts 13 and 14 placed next to one another in switch chamber 12. The switch chamber 12, lies beneath switch knob 3. It is not necessary for switch contacts 13 and 14 to be placed next to one another in all of the switch chambers 12. Above switch chambers with only one switch contact, the insert 9 is superfluous. In the present embodiment, the flat carrier 11 is made up of a foil switch consisting of a spacer foil 15 and conductive foils 16 and 17, with the strip conductors of the conductive foils 16 and 17 located in the switch chamber 12 forming contact surfaces 13′ and 13″ and contact surfaces 14′ and 14″. The pair of contact surfaces 13′ and 13″ make up switch contact 13 and the pair of contact surfaces 14′ and 14″ make up switch contact 14. Further, each contact surface 13′ or 14′ lies immediately opposite the corresponding contact surface 13″ or 14″ which together make up a respective switch contact 13 or 14.

Turning next to FIG. 2, the insert 9 of FIG. 1 may be seen in greater detail. The insert 9, which typically is comprised of a spring-elastic part, has an annular edge region 18, which is supported on the carrier 11. Inside the edge region 18 lies an annular outer region 19 and inside the annular outer region 19 lies an inner region 20, also annular but smaller. The regions 18, 19 and 20 are concentric. The outer region 19 is connected with the edge region 18 by means of a web 21. The inner region 20 is connected with the outer region 19 by means of a web 22. The webs 21 and 22 are offset by 180° with reference to the circumference of the regions 18, 19 and 20, so that the bending capacity of the inner region 20 with respect to the outer region 19, and that of the outer region 19 with respect to the edge region 18, are staggered. In the zone facing the web 22, the inner region 20 forms a switching surface part 23. In the zone facing the web 21, the inner region 20 forms a switching surface part 24. The switching surface parts 23 and 24 are convexly raised with respect to their immediate surroundings.

The alignment of the insert 9 created by the fingers 10 and the cutouts 8 ensures linear alignment between the first switching surface part 23 and the first contact surface pair 13′ and 13″ and between the second switching surface part 24 and the second contact surface pair 14′ and 14″. Alternately, if the contact surfaces 13′, 13″, and 14′ and 14″ lay in a circle concentrically to the regions 19 and 20, alignment by means of the fingers 10 could be omitted.

Returning to FIG. 1, switch knob 3 has on its interior surface a projection 25, which is placed so that when the switch knob 3 is pressed, projection 25 strikes the inner region 20, but not on the outer region 19. The projecting surface 25′ is therefore essentially convex in shape.

The pushbutton switch device described above operates in the following manner:

When the button (not shown in detail) is actuated, the switch knob becomes deformed, and switch knob projection 25, together with the switch knob projecting surface 25′, presses on the projection 28 on the inner region 20 of the insert 9. This presses the first switching surface part 23 onto the conductive foil 17, which in turn presses the contact surfaces 13′ and 13″ into contact, closing first switch contact 13.

The closer the projecting surface 25′ comes to the web 22 on the inner region 20, the greater the multiplication of the movement of the first switching contact part 23 as compared to the movement of the projecting surface 25′, since the distance between the first switching surface part 23 and the connection between the web 22 and the outer region 19 acts as a lever.

Once the switch contact 13 is closed, further movement of the projecting surface 25′, the projection 25 and the switch knob 3 causes the second switching surface part 24 to be carried along by the part of the inner region 20 adjacent to the web 22, so that the second switching surface part 24 contacts the conductive foil 17. First contact surface 14″ will then be pressed into contact with the second contact surface 14′, closing the second switch contact 14.

By such means, closing of the second switch contact 14 is therefore delayed with respect to the first switch contact 13. The web 21 and the outer region 19 themselves ensure that the second switching surface part 24 has sufficient excursion capacity.

Thus there has been described and illustrated herein apparatus for a pushbutton switch device wherein a single switch button may actuate two electrically independent switch contacts. However, those skilled in the art will recognize that many modifications and variations besides those specifically mentioned may be made in the techniques described herein without departing substantially from the concept of the present invention. Accordingly, it should be clearly understood that the form of the invention described herein is exemplary only, and is not intended as a limitation on the scope of the present invention.

What is claimed is:

1. A pushbutton switch device comprising at least one switch element, said switch element comprising a switch chamber defined between first and second elastic foils having a space therebetween, two electrically independent contacts protruding from each of said foils into said switch chamber, each of said contacts protruding from said first foil opposing one of said electrically independent contacts protruding from said second foil, said electrically independent contacts forming a first and second contact pair respectively, a switch button arrangement comprising a switch knob arranged for actuation of said first and second switch contact pairs, wherein the stroke of said switch knob needed to actuate said second switch contact pair is greater than the stroke needed for actuation of said first contact pair, and a spring elastic insert placed between the switch knob and one of the foils defining the switch chamber, said insert having an inner region, an outer region, an edge region, a first web and a second web, said inner region and said outer region being connected by said first web, said outer region and said edge region being connected by said second web, such that when said switch knob acts upon said insert, said inner region actuates said first switch contact pair, and upon further acting of said switch knob upon said insert, said inner region actuates said second switch contact pair.

2. A pushbutton switch device according to claim 1, characterized in that said outer region encloses said inner region in an annular manner.

3. A pushbutton switch device according to claim 1, characterized in that said first and second webs are offset by approximately 180° on said outer region.

4. A pushbutton switch device according to claim 1, characterized in that said insert further comprises a projection extending towards said switch knob, said projection formed on said inner region of said insert, such that said switch knob will strike said projection when said switch knob is acted upon.

5. A pushbutton switch device according to claim 4, characterized in that said switch knob further comprises a switch knob projection extending towards said insert, such that said switch knob projection will strike the inner region of said insert when said switch knob is acted upon.

6. A pushbutton switch device according to claim 1, characterized in that said switch knob further comprises a switch knob projection extending towards said insert, such that said switch knob projection will strike the inner region of said insert when said switch knob is acted upon.

7. A pushbutton switch device according to claim 1, characterized in that said insert is made of spring-elastic plastic.

8. A pushbutton switch device according to claim 2, characterized in that said insert is made of electrically conductive material, said insert acting as an additional contact with said first foil.

9. A pushbutton switch according to claim 1, characterized in that said swich element further comprises a spacer foil having cutouts and said insert further comprises at least one finger such that said at least one finger engages said spacer foil cutouts.

10. A pushbutton switch device according to claim 1, characterized in that said switch button arrangement further comprises a dimensionally stable carrier plate.

11. A pushbutton switch device according to claim 1, characterized in that said pushbutton switch device further comprises a dimensionally stable carrier plate.

* * * * *